US005127200A

United States Patent [19]

Doran

[11] Patent Number: 5,127,200

[45] Date of Patent: Jul. 7, 1992

[54] EAVESTROUGH DEBRIS PROTECTION MECHANISM

[76] Inventor: Scott A. Doran, 4513 E. Milham Rd., Kalamazoo, Mich. 49001

[21] Appl. No.: 680,847

[22] Filed: Apr. 5, 1991

[51] Int. Cl.[5] ..... E04D 13/00

[52] U.S. Cl. ..... 52/12; 248/48.1; 15/160; 15/27

[58] Field of Search ..... 52/11, 12; 15/160, 27; 248/48.1, 48.2

[56] References Cited

U.S. PATENT DOCUMENTS

| | | | |
|---|---|---|---|
| 2,569,568 | 10/1951 | Lipshaw | 52/12 X |
| 2,873,700 | 2/1959 | Heier | 52/12 |
| 3,053,393 | 9/1962 | McLean | 52/12 X |
| 3,601,835 | 8/1971 | Morgan | 15/105 X |
| 3,626,542 | 12/1971 | Jespain et al. | 15/236 X |
| 3,950,951 | 4/1976 | Zukauskas | 52/12 X |
| 3,972,552 | 8/1976 | Earp, Jr. | 15/104.36 X |
| 4,032,456 | 6/1977 | Berce | 52/12 X |
| 4,117,635 | 10/1978 | Nelson | 52/11 |
| 4,310,940 | 1/1982 | Moore . | |
| 4,852,308 | 8/1989 | Papenbrock et al. | 52/12 |
| 4,959,932 | 10/1990 | Pfeifer | 52/12 |
| 4,965,969 | 10/1990 | Antenen | 52/12 |

*Primary Examiner*—David A. Scherbel
*Assistant Examiner*—Lan Mai

[57] ABSTRACT

A mechanism for protecting an eavestrough against the accumulation of leaves and other debris. Apertured cover plates are positioned along the eavestrough to intercept water descending from the roof into the trough. The water passes through the apertures, while the debris is trapped on the cover plate surface. Debris accumulations on the cover plate can be removed by a sweeper mechanism that is movable longitudinally along the cover plate surface. An angled blade on the sweeper mechanism plows the debris forwardly off the front edge of the cover plate.

6 Claims, 1 Drawing Sheet

EAVESTROUGH DEBRIS PROTECTION MECHANISM

BACKGROUND AND SUMMARY OF THE INVENTION

This invention relates to a mechanism for protecting an eavestrough against the accumulation of airborne debris therein.

Conventional eavestroughs sometimes become clogged with leaves, twigs and other debris that blow into the trough interior, or flow into the trough with the rain water coming off the roof. Some of the debris may be retained on the bottom wall of the eavestrough where it can act as an obstruction to flow of water along the trough. If the debris is permitted to remain in the eavestrough for a prolonged period of time it can cause the trough wall to rust or corrode; in some cases the corrosion can produce holes in the trough wall. Manual removal of debris from eavestroughs involves reaching into the trough and scooping clumps of leaves, twigs, mud, etc. out of the troughs space; the process has to be performed while standing on a ladder. The process is a troublesome and disagreeable task. Various shovel-like devices have been developed to more efficiently carry out the task. However, the process is nevertheless still time-consuming and troublesome.

The present invention relates to a mechanism for protecting eavestroughs against the accumulation of leaves and other debris in the trough interior spaces The debris-protection mechanism includes an apertured cover plate overlying the eavestrough to intercept rain water flowing off the building roof into the eavestrough. Apertures in the cover plate permit the water to pass into the eavestrough; leaves and any other debris are retained on the upper surface of the cover plate. In windy conditions some of the debris may blow off the cover plate surface.

A manually-operated sweeper means is used to remove debris from the cover plate surface. In one form of the invention the sweeper means comprises a carriage having two support rollers rollable on the upper surface of the cover plate. A person standing on the ground below the eavestrough can manipulate an elongated handle for remotely propelling the carriage along the space above the cover plate; an angled blade on the leading end of the carriage pushes debris off the front edge of the cover plate. Periodic traversing movement of the carriage along the cover plate surface will keep the cover plate relatively clear of accumulated debris.

If the sweeper carriage is fully efficient as a debris-removal mechanism there should be no need to have access to the interior spaces within the eavestrough. However the cover plate is preferably removably connected to the eavestrough, such that access can be had to the eavestrough interior spaces when necessary, e.g. to remove extremely fine particles that may have passed through the apertures in the cover plate, or to repair the eavestrough, or to paint the eavestrough.

THE DRAWINGS

DESCRIPTION OF A PREFERRED EMBODIMENT OF THE INVENTION

Figure 1:
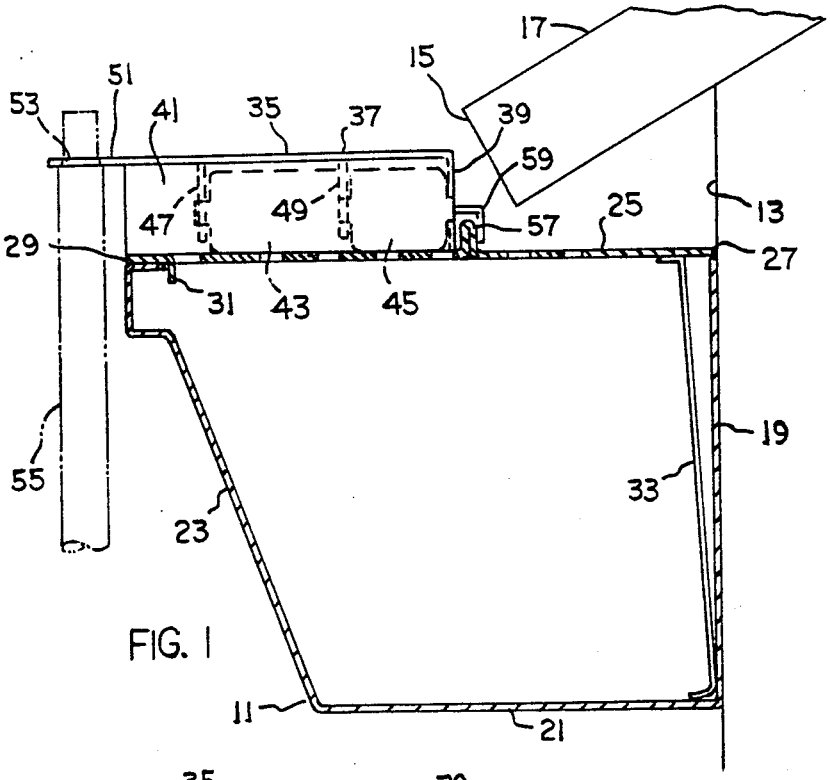
FIG. 1 is a transverse sectional view taken through an eavestrough having a debris protection mechanism of the present invention installed thereon.

FIG. 1 shows a conventional eavestrough 11 mounted on the exterior surface 13 of a building wall just below the lower edge 15 of a sloped roof 17. The eavestrough has a back wall 19, bottom wall 21 and front wall 23. An apertured cover plate 25 is removably disposed on the eavestrough to intercept water flowing downwardly off roof 17 into the eavestrough. Rear edge 27 of the coverplate is located in near proximity to the upper edge of the eavestrough back wall 19. The front edge area 29 of the cover plate overlies the upper edge of the eavestrough front wall 23.

At spaced points along the length of the cover plate tabs 31 are struck down from the cover plate material. Each tab 31 constitutes a stop means for preventing forward dislocation of the cover plate from the eavestrough. The cover plate has at least two downwardly extending leg elements 33 affixed thereto near its rear edge. These leg elements act as support devices for the rear portion of the cover plate. The cover plate is supported along its front edge by its engagement with the upper edge of front wall 23.

Figure 2:
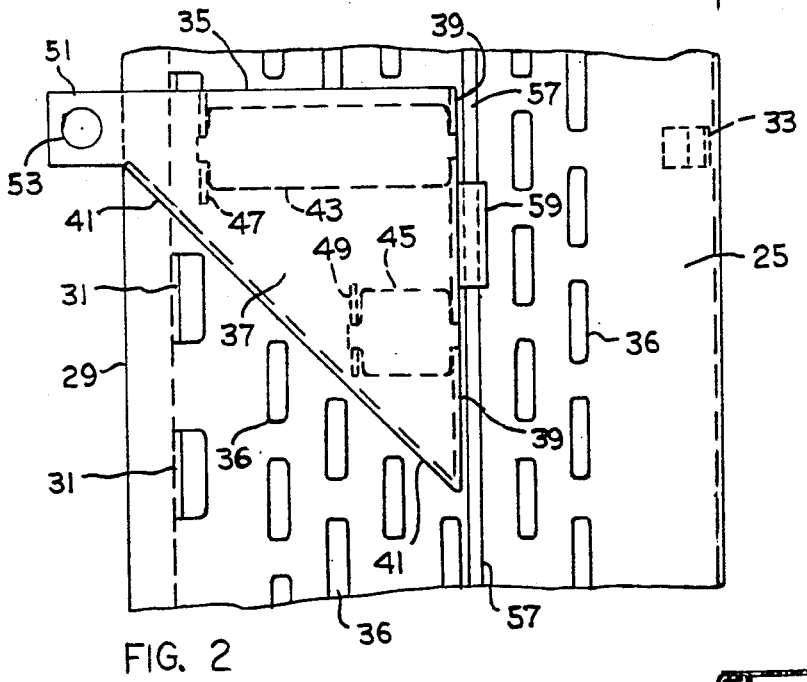
FIG. 2 is a fragmentary top plan view of the FIG. 1 mechanism.

As shown in FIG. 2, cover plate 25 has a large multiplicity of rectangular low apertures 36 covering substantially its entire surface between its front edges and its rear edge. The flow apertures may not be needed along the plate rear edge, since downflow of water near the plate rear edge is minimal at best. The flow apertures extend the full length of the cover plate to trap debris on the plate upper surface while permitting downflow of water into the eavestrough.

In a typical residential building an eavestrough will extend along the entire length of the roof lower edge; this distance may be thirty feet or more, depending on the size of the building. Cover plates 25 will preferably extend the entire length of each eavestrough in order to provide complete debris shielding for the eavestrough. The cover plates will be formed in relatively short sections to facilitate shipment and handling. A cover plate length of approximately six or eight feet is considered a practical length. The cover plates will be placed end-to-end along the eavestrough. Each cover plate is removably disposed on the eavestrough, whereby it can be lifted away from the eavestrough should it be necessary to gain access to the interior space within the eavestrough.

Each cover plate 25 can be formed of a metal sheet, as shown in FIG. 1; the flow apertures can be of a single size and shape or a range of different sizes and shapes. Alternatively each cover plate can be formed of a foraminous screen material reinforced as necessary to support the weight of debris accumulations on its upper surface.

Debris accumulating on cover plate 25 can be removed by a debris sweeper carriage 35. The carriage includes a horizontal roof wall 37, a rear wall 39, and an angled blade 41. The lower edge of the blade is in close proximity to the surface of cover plate 25. Two rollers 43 and 45 are located beneath roof wall 37 to rollably support the carriage for movement longitudinally along the array of cover plates overlying the associated eavestrough. Each roller has an axle having one end thereof extending through wall 39 and the other end extending through a roller support plate 47 or 49 depending from roof wall 37.

Roof wall 37 has a forward extension 51 formed with a socket opening 53 that is adapted to receive the end portion of an elongated actuator rod 55. A person standing on the ground can move rod 55 longitudinally along the eavestrough to move sweeper carriage 35 along the array of cover plates 25. As the carriage moves over the cover plate surface blade 41 exerts a plowing force on any debris lying on the coverplate surface. Blade 41 is angled to the direction of carriage motion at an angle of approximately forty-five degrees. This angulation causes the debris to be pushed forwardly off the forward edge 29 of the coverplate.

Sweeper carriage 35 is guided by means of an upstanding track wall 57 formed on cover plate 25; the track wall extends the full length of the associated cover plate. When a number of cover plates are positioned end-to-end on an eavestrough the various track walls 57 align with each other to form a guidance track extending the total length of the cover plate assembly. Rear wall 39 of the carriage rides along the front face of track wall 57. A section of the rear wall is cut and deformed to extend behind the rear wall, as shown at 59 in FIG. 1. The deformed wall section forms a guide element movable along the rear face of track wall 57, such that carriage 35 is guided against inadvertent motion out of its intended motion path.

Carriage 35 can be left on the cover plate during periods when it is in an inactive state. In that case the carriage will have a detachable connection with actuator rod 55. Alternatively, carriage 35 can be removed from its position on the cover plate when it is not in active use as a sweeper means. In that case the carriage could have a permanent connection with actuator rod 55.

Figure 3:
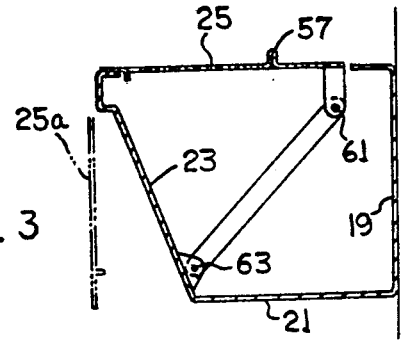
FIG. 3 is a sectional view taken through an eavestrough having another mechanism of the invention associated therewith.

FIGS. 1 and 2 show a preferred cover plate construction that can be completely removed from the associated eavestrough. FIG. 3 shows an alternate arrangement wherein the plate has a hinged connection with the eavestrough. In this case, the cover plate has two longitudinally spaced support elements 33*a;* one of the support elements is shown in FIG. 1.

Each support element 33*a* has a pivotal connection 61 with the cover plate and a second pivotal connection 63 with an interior surface of the eavestrough. The cover plate can be drawn forwardly and tilted downwardly to the dashed line position 25*a*. In the dashed line position of the cover plate the interior surface of the eavestrough is accessible, e.g. for debris removal, painting or repair.

The invention has necessarily been illustrated in a specific configuration. However, it will be appreciated that changes and modifications could be made while still practicing the invention.

What is claimed is:

1. A mechanism for protecting an eavestrough against the accumulation of airborne debris therein, wherein the eavestrough has a back wall with an upper edge, a front wall with an upper edge, and a bottom wall connecting the back wall to the front wall: said mechanism comprising an apertured cover plate positionable on the eavestrough in the path of water descending from the roof into the eavestrough; said apertured cover plate having a rear edge located near the upper edge of the eavestrough back wall, a front edge overlying the upper edge of the eavestrough front wall, and an upper plate surface extending between the cover plate front and rear edges; a stop means extending downwardly from the apertured cover plate near its front edge to prevent forward dislocation of the apertured cover plate from the eavestrough; an upstanding track on the apertured cover plate extending parallel to the plate rear edge; and a debris sweeper means positionable on the upper surface of the apertured cover plate for linear motion parallel to the cover plate front edge; said debris sweeper means including a plow element extending at an acute angle to the front edge of the apertured cover plate whereby said plow element is enabled to push debris off the plate front edge; said debris sweeper means being guidably engaged with said upstanding track whereby said sweeper is guided along a linear path as it moves along the upper surface of the apertured cover plate.

2. The mechanism of claim 1, wherein said upstanding track consists of a thin linear wall projecting upwardly from the apertured cover plate.

3. The mechanism of claim 2, wherein said linear track wall has a front face and a rear face; said debris sweeper means having a rear wall oriented to ride along the front face of said linear track wall.

4. The mechanism of claim 3, and further comprising a guide element carried by the rear wall of the debris sweeper means for movement along the rear face of said linear track wall.

5. The mechanism of claim 2 wherein said debris sweeper means comprises two parallel rollers having their rotational axes extending normal to the linear track wall; said rollers being rollable on the upper surface of the apertured cover plate to advance the plow element along said cover plate.

6. The mechanism of claim 5, wherein said plow element comprises an upstanding blade having a lower edge extending in close proximity to the upper surface of the apertured cover plate.

* * * * *